US005652941A

United States Patent [19]

Arimoto et al.

[11] Patent Number: 5,652,941

[45] Date of Patent: Jul. 29, 1997

[54] FILM LEADER AND ARRANGEMENT FOR COUPLING FILM TO LEADER

[75] Inventors: Keigo Arimoto; Shigeru Masuda, both of Wakayama, Japan

[73] Assignee: Noritsu Koki Co., Ltd., Japan

[21] Appl. No.: 567,170

[22] Filed: Dec. 5, 1995

[30] Foreign Application Priority Data

| | | | |
|---|---|---|---|
| Apr. 19, 1995 | [JP] | Japan | 7-093506 |
| Jul. 4, 1995 | [JP] | Japan | 7-168643 |
| Jul. 4, 1995 | [JP] | Japan | 7-168783 |
| Sep. 7, 1995 | [JP] | Japan | 7-230253 |
| Sep. 7, 1995 | [JP] | Japan | 7-230309 |

[51] Int. Cl.[6] ..... G03D 13/10

[52] U.S. Cl. ..... 396/652

[58] Field of Search ..... 354/319–321, 354/339, 340, 344–346; 226/91, 92; 352/235; 242/332, 332.4; 396/612, 617, 620, 621, 628, 642, 651, 652

[56] References Cited

U.S. PATENT DOCUMENTS

| | | | |
|---|---|---|---|
| 3,646,872 | 3/1972 | Bowlby | 354/310 |
| 4,110,774 | 8/1978 | Krehbiel et al. | 354/345 |
| 5,381,203 | 1/1995 | Grusetski et al. | 354/345 |
| 5,463,441 | 10/1995 | Tamaguchi | 354/345 X |
| 5,475,463 | 12/1995 | Yamaguchi et al. | 354/345 X |

FOREIGN PATENT DOCUMENTS

| | | |
|---|---|---|
| 0 631 187 | 6/1994 | European Pat. Off. . |

*Primary Examiner*—D. Rutledge

*Attorney, Agent, or Firm*—Wenderoth, Lind & Ponack

[57] ABSTRACT

A coupling structure capable of coupling films to a leader with high reliability. The leader has a leader body formed with first holes and second holes in its rear with respect to the feed direction of the leader. Sheet members having fingers or protrusions are provided on the leader body so that the fingers extend across the respective first holes. Films having holes formed in its leading end, are coupled to the leader body by inserting their leading ends through second holes and then into the first holes until the fingers engage in the holes formed in the films.

20 Claims, 13 Drawing Sheets

FILM LEADER AND ARRANGEMENT FOR COUPLING FILM TO LEADER

BACKGROUND OF THE INVENTION

The present invention relates to a leader used in automatically developing photographic films and a coupling means for coupling such a leader to films.

When developing films in an automatic film developing machine of the type that utilizes a leader to guide films, films 61 from casing 60 are connected at their leading ends to a leader 62 as shown in FIG. 18. The films 61 are then fed into the machine and are guided by the leader 62.

The leader 62 is a flexible synthetic resin sheet formed with a plurality of equally spaced holes 63 arranged in a feed direction. The holes 63 are adapted to engage a leader feed sprocket provided in the film developing unit.

If a film 61 should separate from the leader 62 and sink into a developing tank filled with developing solution, The film 61 has to be taken out of the tank which interrupts the developing operation. This work is troublesome and time-consuming. Also, there is the possibility that the film might be inadvertently exposed to light while taking it out of the developing tank. In order to prevent such an accident, every film 61 has to be securely connected to a leader 62.

Films 61 are usually connected to the leader 62 by means of splicing tapes 64. But splicing tapes 64 are difficult to handle, firstly because they have to be applied to the films and the leader while placing them on a special workbench to couple them together with high accuracy, and secondly because it is troublesome to detach the tapes from the films and the leader after developing films. The use of such tapes is also disadvantageous from an economical viewpoint because they are not reusable.

U.S. Pat. No. 4110774 discloses a coupling means that requires no splicing tape. Rather, in this arrangement, a film is hooked to a leader as shown in FIGS. 19 and 20. The coupling means shown in these figures includes a tongue 72 defined by two cuts 71 in the rear end of a leader 70 which is formed of a flexible sheet, and an opening 74 formed in the leading end of a film 73. The film is coupled to the leader 70 by inserting the tongue 72 of the leader into the opening 74 of the film so that a neck portion 75 of the tongue engages the side edges of the opening 74.

Since no splicing tape is needed in this arrangement, the film can be coupled to the leader economically. Since the tongue 72 extends rearwardly with respect to the feed direction of the leader 70, it will never get caught or stuck in the film feed path, so that it is possible to feed the leader 70 smoothly through the film feed path. Also, it is possible to couple the film to a desired point on the leader with a high degree of accuracy.

In order to insert the tongue 72 into the opening 74 or to pull it out of the opening 74, the former has to be bent arcuately in the width direction because the width W1 of the tongue 72 is larger than the width W2 of the opening 74.

Such a delicate operation is beyond the capacity of a machine. Thus, in this arrangement, automatic connection and disconnection of the leader and the film are impossible.

While being fed through the film feed path in the automatic film developing machine, the film 73 tends to be subjected to a rather large tensile force at a turning point in the film feed path. Such a tensile force tends to be concentrated on the tongue 72, so that the tongue 72 may be deformed and come out of the opening 74. Thus, this coupling means cannot couple the leader and the film with sufficiently high reliability.

Moreover, since the film 73 is bendable about the neck portion 75 of the tongue 72, it tends to meander and get damaged by being brought into contact with the film feed path.

An object of this invention is to provide a leader and a coupling means for coupling a film to a leader which enable the film to be connected to and disconnected from the leader easily, reliably and, if so desired, automatically.

SUMMARY OF THE INVENTION

According to this invention, there is provided a leader including a leader body formed of a flexible sheet and having a plurality of holes formed at equal intervals for feeding the leader. The leader body has film inserting holes formed in its rear portion with respect to the feed direction of the leader. Protrusions extend across the film inserting holes in the feed direction of the leader. The protrusions have front ends, with respect to the feed direction of the leader, integrally connected with the leader body and rear ends with respect to the feed direction of the leader, which are supported on edge portions of the film inserting holes.

The protrusions may be portions of sheet members fastened to the front of the leader body, or may be integrally formed on the front edges of the film inserting holes. In the matter case, sheet members should be bonded to the back of the leader body to support the rear ends of the protrusions.

Engaging holes are formed in the leading end of each film so that by inserting such films into the film inserting holes of the leader, the protrusions will engage in the engaging holes formed in the films.

In order to stably and reliably connect films to the leader, it is preferable to provide the leader with film insertion cutouts in the rear of the film inserting holes and with engaging protrusions or projections provided at both sides of the cutouts and adapted to engage both sides of a film inserted in each cutout. Instead of such cutouts and protrusions, second film inserting holes may be formed rearwardly of the film inserting holes.

Other features and objects of the present invention will become apparent from the following description made with reference to the accompanying drawings, in which:

DETAILED DESCRIPTION OF THE PREFERRED EMBODIMENT

Figure 1:
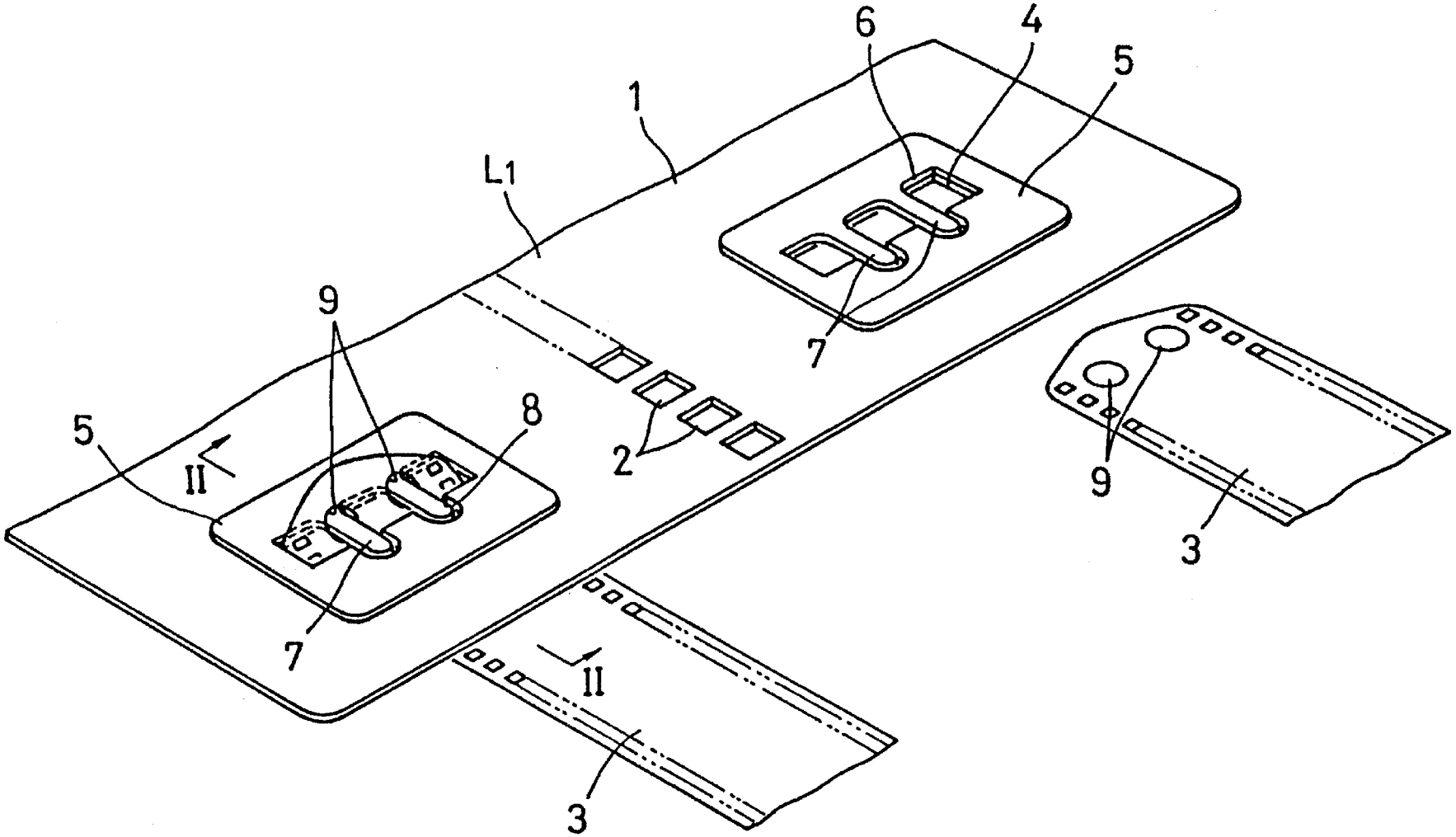
FIG. 1 is a perspective view of a first embodiment of the present invention.

The embodiments of the present invention are described with reference to FIGS. 1–17.

FIGS. 1–4 show the first embodiment of the present invention. As shown, a leader L1 includes a flexible leader body 1 formed of a synthetic resin sheet. It is formed with a plurality of holes 2 arranged along a feed direction at equal intervals. The leader L1 is fed in one direction by engaging a sprocket in the holes 2 and rotating the sprocket. The leader body 1 has holes 4 in the rear portion thereof on both sides of the holes 2. A film 3 can be inserted in each hole 4.

The holes 4 have a width substantially equal to the width of film 3. By inserting the films 3 into holes 4, both edges of the films 3 abut both sides of the holes 4, so that they will scarcely shake while being fed.

Sheets 5 are superimposed on the leader body 1 to cover the respective holes 4. The sheets 5 are fastened to the leader L1 by bonding or fusing.

Each sheet member 5 has a window 6 that registers with the hole 4. Resilient protrusions 7 are formed on the front edge (with respect to the feed direction of the leader) of each window 6. The protrusions 7 extend across the holes 4 along the feed direction of the leader L1 so that their free ends are supported on the leader body 1 near the rear edges of the holes 4.

The leading end of each film 3 is provided with holes 9. The protrusions 7 are adapted to engage in the holes 9, respectively.

In order to connect the films 3 to the leader L1 accurately with little possibility of the films 3 inclining relative to the leader L1, each film 3 should have more than one hole 9 to receive a plurality of protrusions 7.

Figure 3:
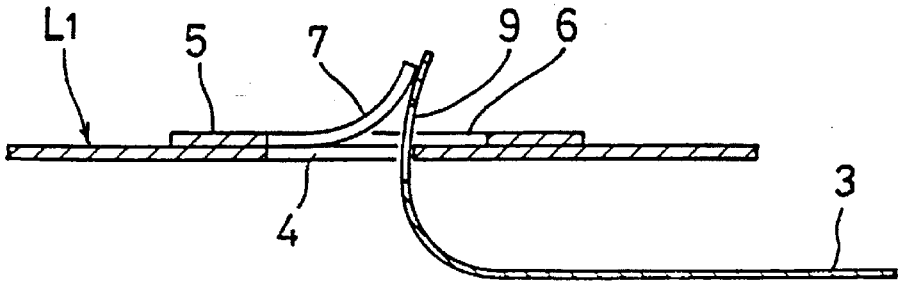
FIG. 3 is a sectional view showing an intermediate state of a film connecting step.
Figure 4:
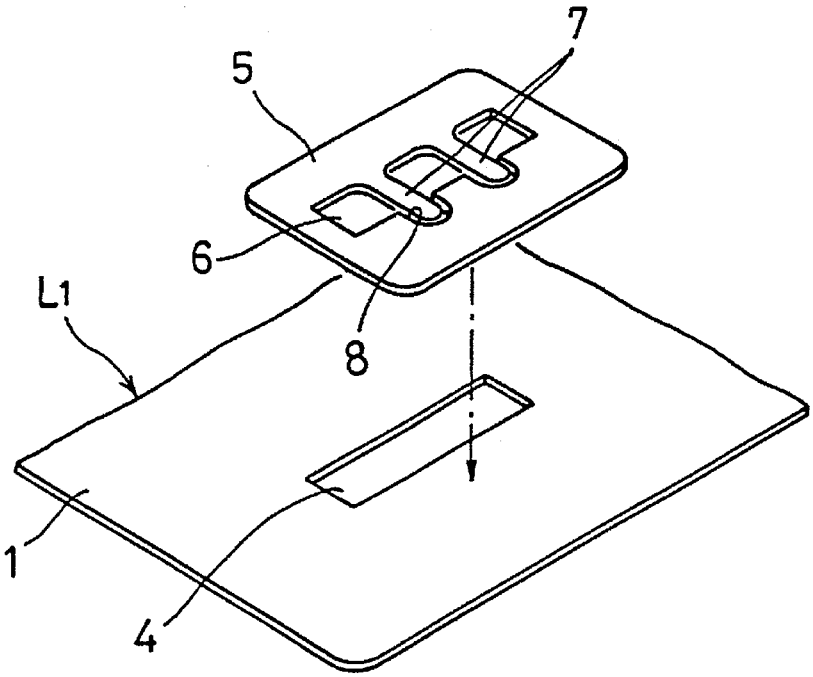
FIG. 4 is an exploded perspective view of part of a leader and a sheet member.

By inserting the leading end of each film 3 into the hole 4 and the window 6, the protrusions 7 are deflected upwardly by being pushed by the leading end of the film 3 as shown in FIG. 3.

Figure 2:
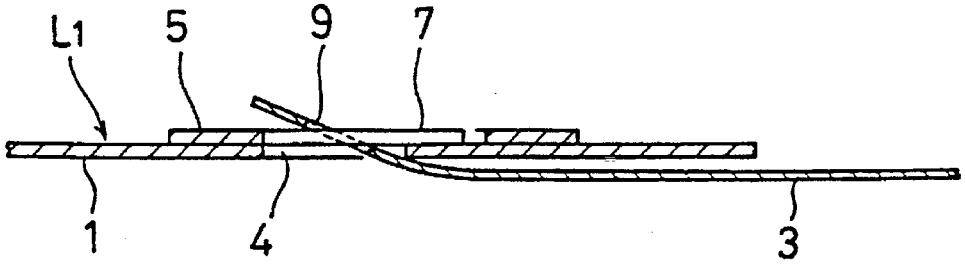
FIG. 2 is a sectional view taken along line II—II of FIG. 1.

When each film 3 is inserted until its holes 9 face or oppose the protrusions 7, the protrusions 7 will We urged into the holes 9 due to their own resilient restoring force. By pulling back the film 3 in this state, the protrusions 7 are allowed to return to their original rest positions. The film 3 is thus coupled to the leader L1 as shown in FIG. 2. In the above manner, each film 3 can be automatically coupled to the leader L1 by pushing each film into the respective hole 4 by a predetermined distance and then pulling the film back.

Once coupled to the leader L1, the films 3 are rigidly connected to the leader L1 with the free ends of the protrusions 7 supported on the rear edges of the holes 4 so that they will not be deflected downwardly.

The films 3 are then fed, guided by the leader L1, into the film developing unit for development. Since the protrusions 7 extend rearward with respect to the feed direction of the leader, they will never get caught or stuck in a film feed path. Therefore, the leader L1 and the films 3 can be fed smoothly along the film feed path.

While being fed, both side edges of each film 3 abut respective sides of the holes, so that the film will never shake or meander.

While being fed, a tensile force may act on the films 3 in such a way as to deform the protrusions 7 downwardly from the position shown in FIG. 2. But actually, the protrusions 7 never deform in that way because their free ends rest on the leader body 1 near the rear edges of the holes 4. Thus, the possibility of the films 3 coming off the leader is practically nil.

To detach films 3 from the leader, the films 3 are pushed forward to raise the protrusions 7 until they completely disengage from the holes 9, and then the films are pulled back.

In their rest positions, the protrusions 7, formed integral with the sheet members 5, are flush with the top surfaces of the sheet members 5 fastened to the leader body 1. Thus, the protrusions 7 are less likely to be deformed by being caught by e.g. fingertips than protrusions directly fastened to the leader body 1.

Figure 5A:
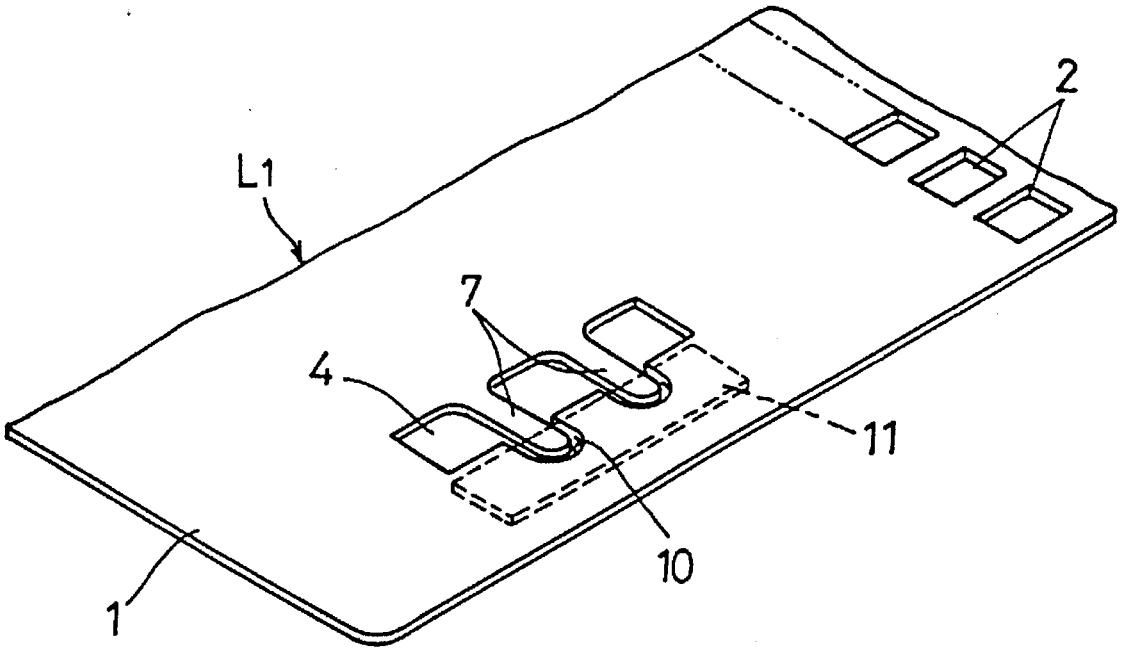
FIG. 5A is a perspective view of a second embodiment of the present invention.
Figure 5B:
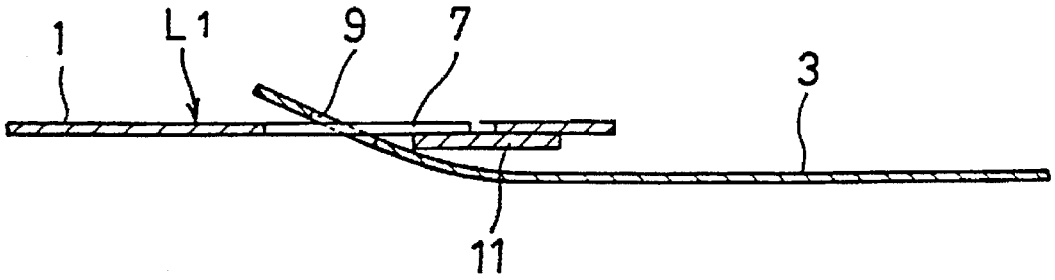
FIG. 5B is a sectional view of the embodiment shown in FIG. 5A.

FIGS. 5A and 5B show the second embodiment of the present invention. In this embodiment, protrusions 7 extend rearwardly from the front edge (with respect to the feed direction of the leader) of each hole 4 formed in the leader body 1. Along the rear edge of each hole 4 are formed cutouts 10 in which the tips of the protrusions 7 are received.

Sheets 11 are bonded or otherwise fastened to the back or bottom surface of the leader body 1 to cover the cutouts 10 and support the tips of the protrusions 7.

Similar to the first embodiment, the protrusions 7 extend rearwardly with respect to the feed direction of the leader L1, so that the protrusions 7 are not likely to get caught or stuck in the feed path. It is also possible to automatically connect and disconnect the films and the leader.

In both the first and second embodiments, by engaging the tips of the protrusions 7 in the cutouts 8 or 10, they are kept from rocking while being fed, so that the films 3 can be reliably kept connected to the leader by the protrusions.

Figure 6:
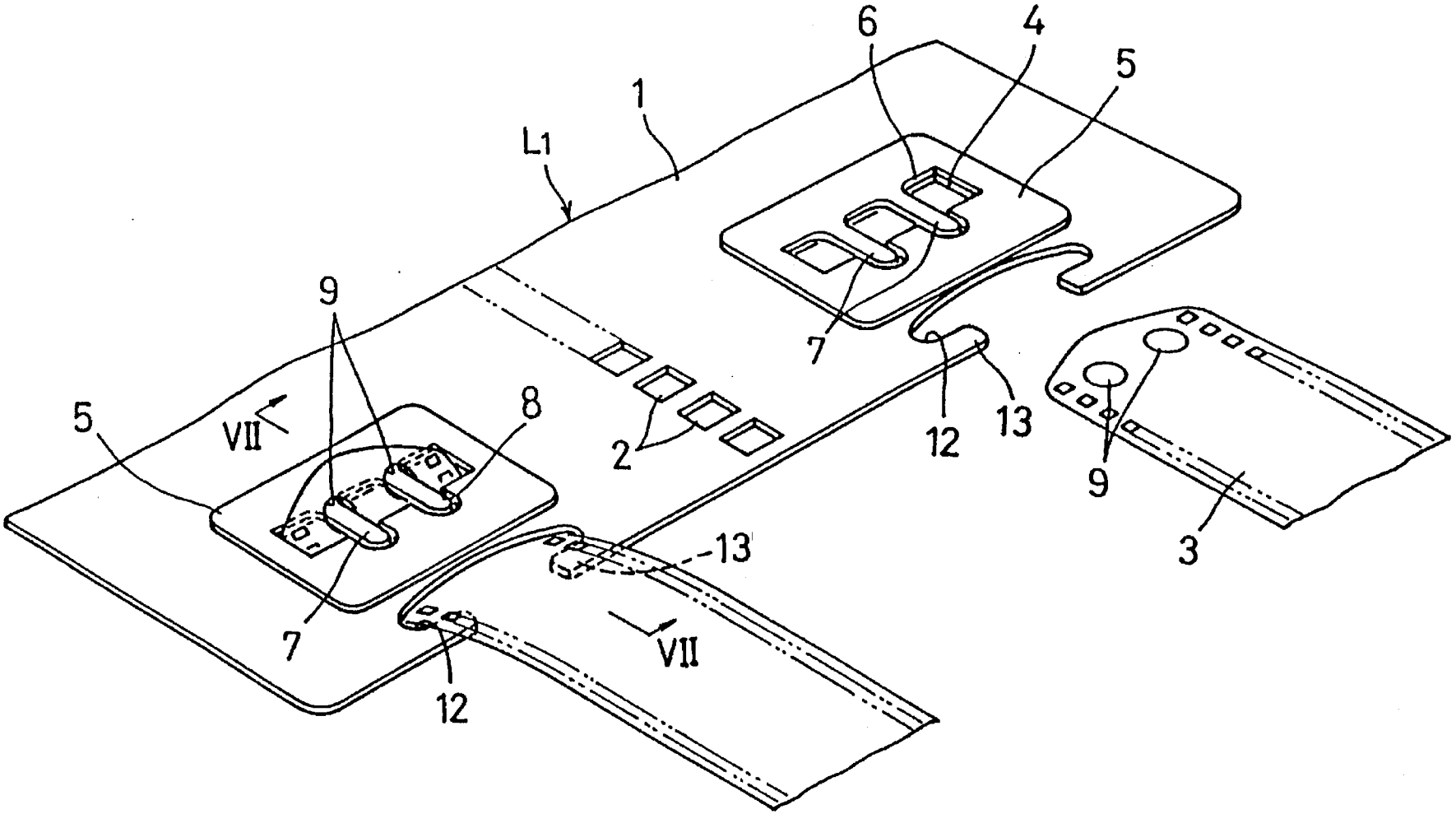
FIG. 6 is a perspective view of a third embodiment of the present invention.
Figure 7:
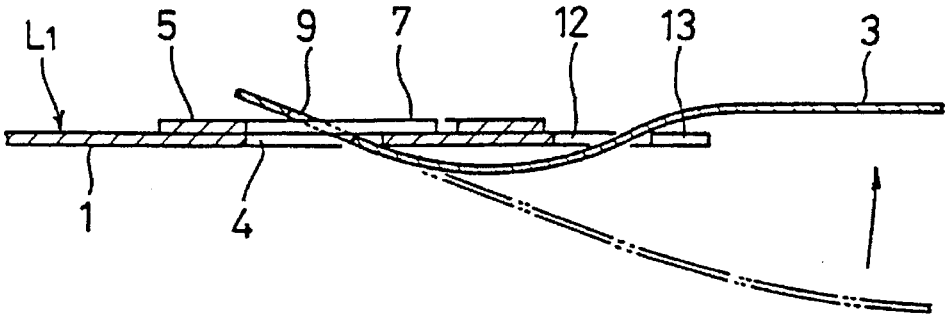
FIG. 7 is a sectional view taken along line VII—VII of FIG. 6.

FIGS. 6 and 7 show the third embodiment of the present invention. In the third embodiment, cutouts 12 are formed in the rear (with respect to the feed direction of the leader L1) of the holes 4. Films 3 are inserted into the cutouts 12. Both sides of the cutouts 12 have protrusions or projections 13 which are adapted to engage both sides of the films 3, respectively. It is possible to prevent rocking of the films inserted in the cutouts because the width of each cutout is substantially equal to the width of the respective film 3.

Otherwise, this embodiment is structurally the same as the first embodiment. Thus, like elements are denoted by like reference numerals and their description is omitted.

In the third embodiment, the tip of each film 3 is inserted into the hole 4 of the leader L1 from its back or bottom side until the protrusions 7 engage in the holes 9. The rear portion of the film 3 is then raised to push it into the cutout 12 while resiliently deforming the protrusions 13 upwardly. The film 3 is thus coupled to the leader L1.

In the third embodiment, since the tips of the films 3 are inserted in the holes 4 and the cutouts 12, the protrusions 7 are much less likely to come out of the holes 9 even if a tensile force acts on the films 3 while being fed. As a result, the films 3 can be kept connected to the leader more reliably.

Figure 8:
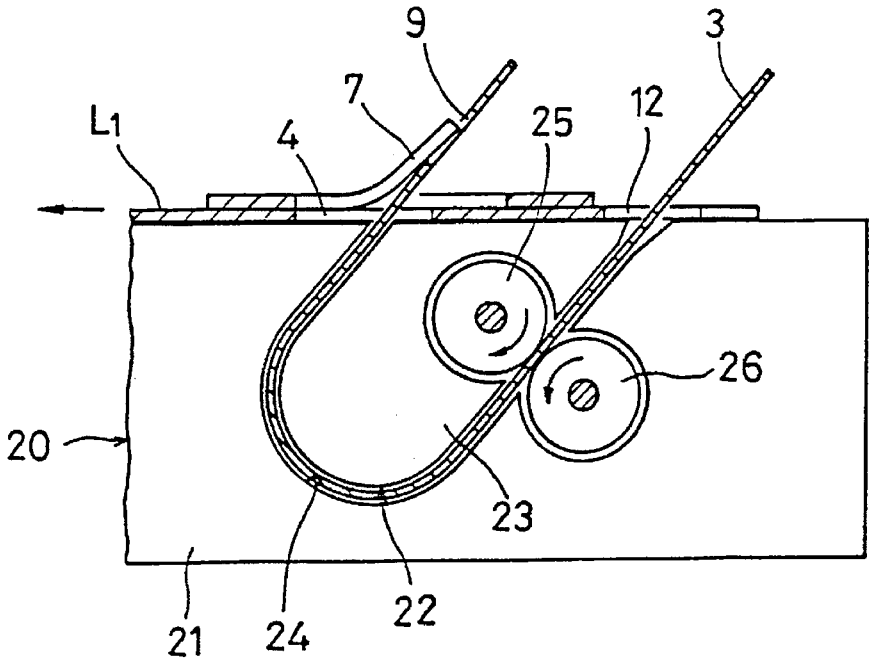
FIG. 8 is a schematic view of a film splicing device.

FIG. 8 shows a splicing device for coupling the films 3 to the leader L1 shown in FIGS. 6 and 7. It includes a lower film guide 20 having a plurality of plate members 21, and an upper film guide 22 having a plurality of plate members 23. A film turning path 24 is defined between the upper and lower film guides 20 and 22. The splicing device is used as follows: the leader L1 is positioned on the lower film guide 20; films 3 are fed through the cutouts 12 into the film turning path 24; and a pair of feed rollers 25, 26 are rotated to feed the films into the holes 4 while deforming the protrusions 7 upwardly until the holes 9 face the protrusions 7 and the protrusions 7 engage in the holes 9 due to the resiliency of the protrusions 7.

Once the protrusions 7 engage in the holes 9, the upper film guide 22 and one of the feed rollers 25, which is supported on the upper film guide 22, are moved a distance equal to or greater than the width of the films 3 in the width direction of the films 3. Then, by moving the leader L1 in the direction of the arrow (FIG. 8), the films 3 can be pulled out of the lower film guide 20.

By using the splicing device illustrated in FIG. 8, the films 3 can be automatically coupled to the leader L1.

Figure 9A:
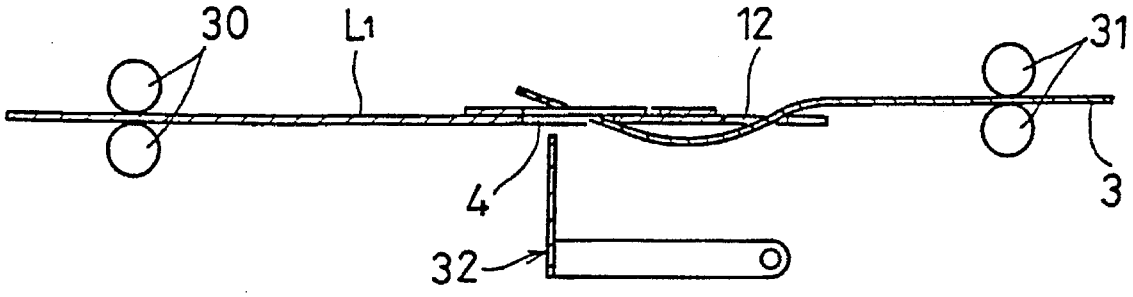
FIGS. 9A–9D show sequential steps of the operation of a film disconnecting device.
Figure 9B:
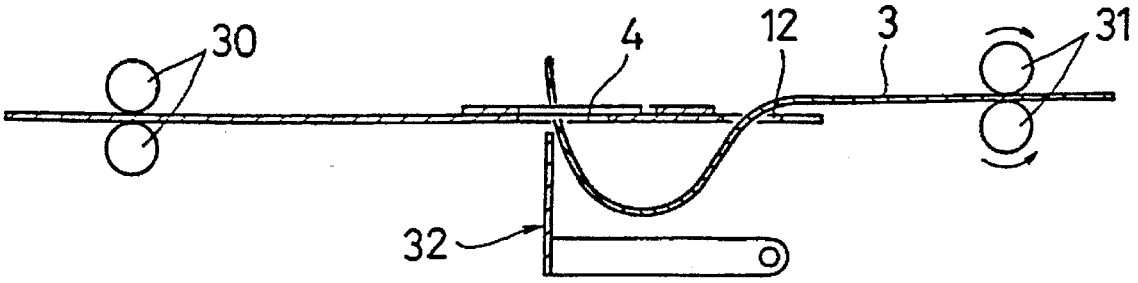
Figure 9C:
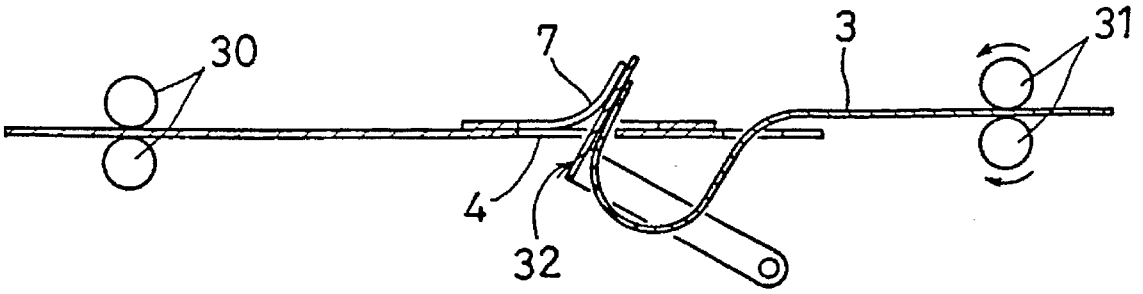

FIGS. 9A–9D show a device for disconnecting the film from the leader. This device is used as follows: the leader L1 and the films 3 spliced to the leader are fed forward by front and rear feed roller pairs 30 and 31 until the holes 4 come right over the tip of a separating tool 32 (see FIG. 9A); only the films 3 are fed further forward by rotating the rear pair of feed rollers 31 to slacken the films 3 between the holes 4 and the cutouts 12 as shown in FIG. 9B; the separating tool 32 is pivoted upwardly to push its tip into the holes while deforming the protrusions 7 upwardly as shown in FIG. 9C. Thus, the protrusions 7 disengage from the holes 9.

Figure 9D:
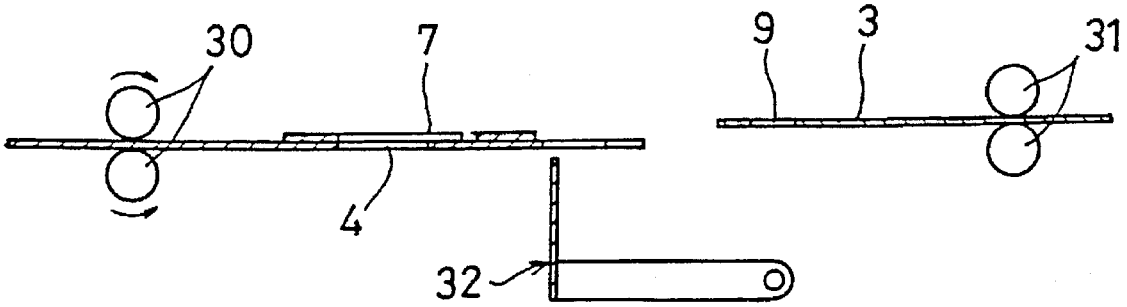

In this state, the rear feed rollers 31 are the turned in reverse to back the films 3 until their tips come out of the holes 4 and the cutouts 12. Then, as shown in FIG. 9D, the separating tool 32 is pivoted downwardly, and the front and rear feed rollers 30 and 31 are rotated to discharge the leader L1 and the films 3 from the feed path.

By using the device shown in FIGS. 9A–9D, it is possible to automatically disconnect the films 3 from the leader L1 shown in FIG. 6. This device can also be used to disconnect films 3 from the leader L1 shown in FIGS. 1 and 5.

FIGS. 10 to 14 show a fourth embodiment of the present invention. In this embodiment, the leader body 1 has first holes 40 and second holes 41 formed rearwardly (with respect to the feed direction of the leader L1) of the first holes 40. Sheets 42 are bonded or otherwise fixed to the top of the leader body 1 so that windows 43 and 44 formed therein register or align with the first holes 40 and the second holes 41, respectively. Each sheet member 42 has resilient protrusions 45 that extend from the front edge (with respect to the feed direction of the leader) of the window 43 rearwardly across the window 43 so that free ends of the protrusions are received in cutouts 46 formed in the sheets 42 along the rear edge of the window 43 and are supported on the leader body 1 near the rear edge of the first holes 40.

Figure 12:
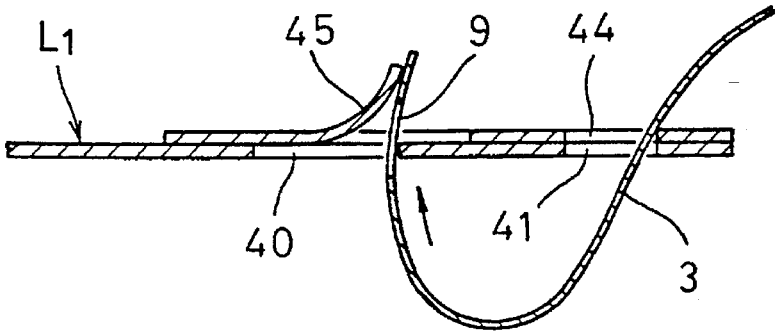
FIG. 12 is a sectional view showing an intermediate state of a film connecting step.
Figure 13:
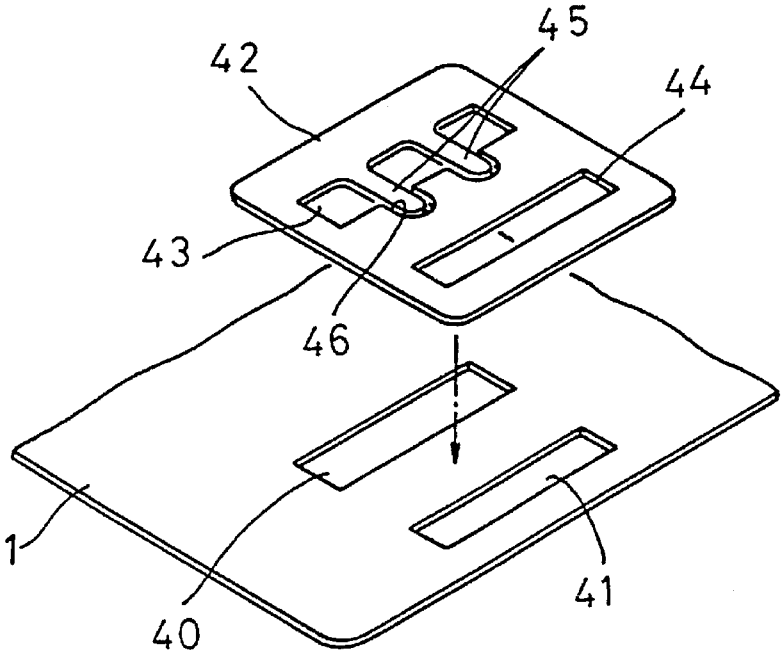
FIG. 13 is an exploded perspective view of a portion of a leader and a sheet member.

In the fourth embodiment, each film is connected to the leader L1 as follows: inserting the film 3 through the window 44 into the second hole 41 so that the film tip protrudes from the back of the leader L1; then inserting the tip of the film through the first hole 40 into the window 43 while deforming the protrusions 45 upwardly as shown in FIG. 12 until the holes 9 face or align with the protrusions 45; and finally pulling the film 3 back to allow the protrusions 45 to be engaged in the holes 9.

Figure 11:
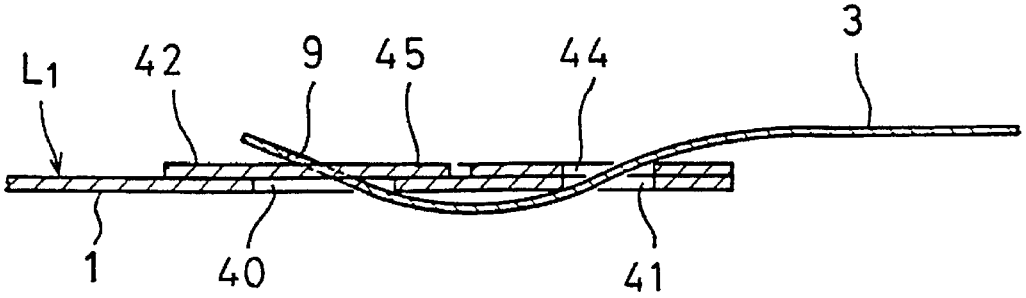
FIG. 11 is a sectional view taken along line XI—XI of FIG. 10.

With each film 3 connected to the leader as shown in FIG. 11, the film contacts the rear edge of the window 44, the front edge of the second hole 41, and the rear edge of the first hole 40. Thus, even if it is subjected to a tensile force while being fed in the film developing unit, such force will be carried mainly by these contact portions, so that the protrusions 45 will not be subjected to undue force. But even if they are, the protrusions 45 are less likely to be deformed because their tips are supported on the leader body near the rear edge of the first hole 40. Thus, the films will very rarely separate from the leader.

Since the widths of the first and second holes 40 and 41 are both substantially equal to the width of the films 3, it is possible to prevent meandering of the films 3 while being fed.

The films can be disconnected from the leader by pushing each film from the second hole 41 toward the first hole 40 in order to raise the protrusions 45 above the sheet member 42 until the protrusions 45 disengage from the holes 9, and then pulling back the film.

The films 3 may be connected to or disconnected from the leader using the splicing device shown in FIG. 8 or the disconnecting device shown in FIG. 9.

Figure 14:
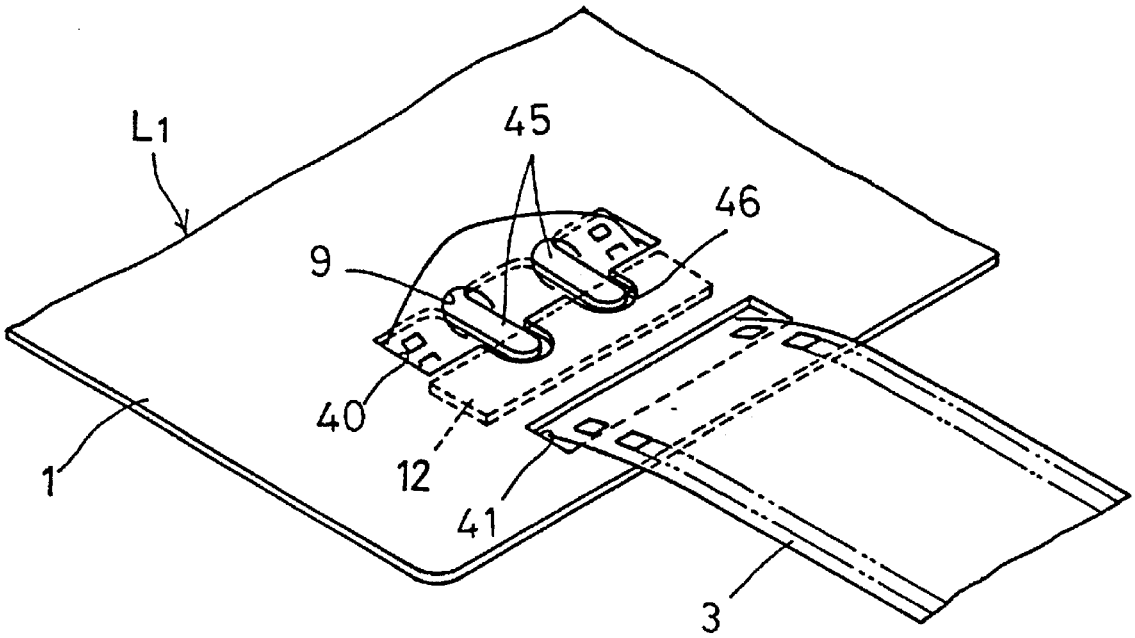
FIG. 14 is a perspective view of a fifth embodiment of the present invention.
Figure 15:
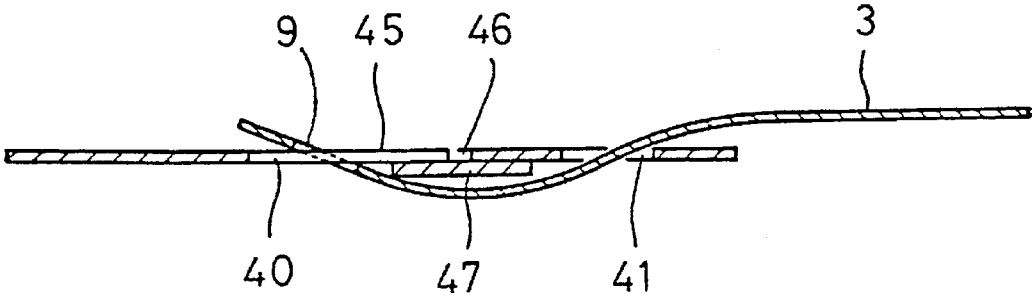
FIG. 15 is a sectional view of FIG. 14.

FIGS. 14 and 15 show a fifth embodiment of the present invention. In this embodiment, first and second holes 40 and 41 are formed in the rear portion (with respect to the feed direction of the leader) of the leader body 1. Protrusions 45 extend rearward from the front edge of the first holes 40.

The tips of the protrusions 45 are received in cutouts 46 formed along the rear edge of the first holes 40 and supported on sheet members 47 which are bonded to the back of the leader body 1.

Figure 10:
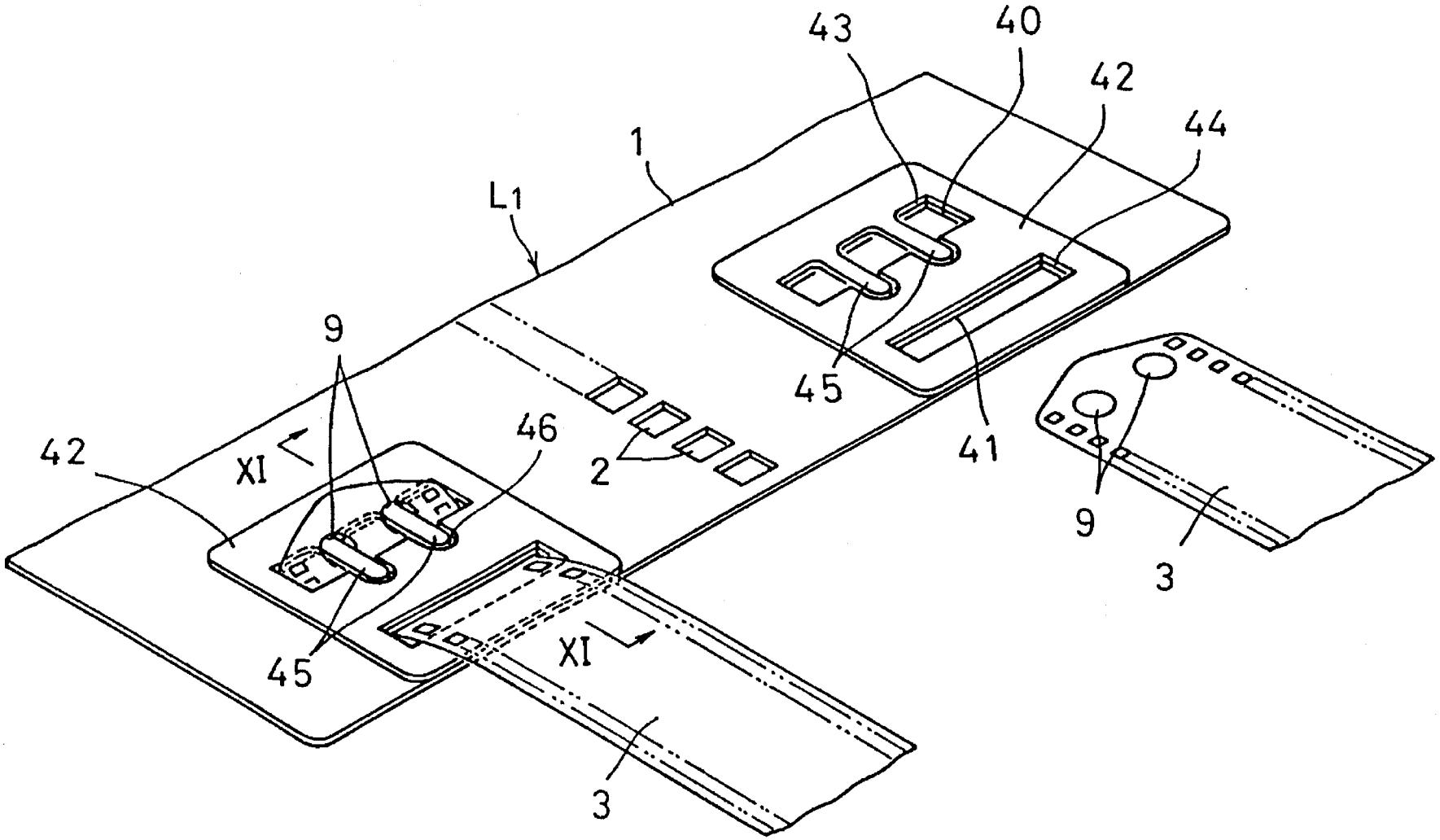
FIG. 10 is a perspective view of a fourth embodiment of the present invention.

The fifth embodiment can achieve substantially the same results/effects as the fourth embodiment shown in FIG. 10.

Figure 16A:
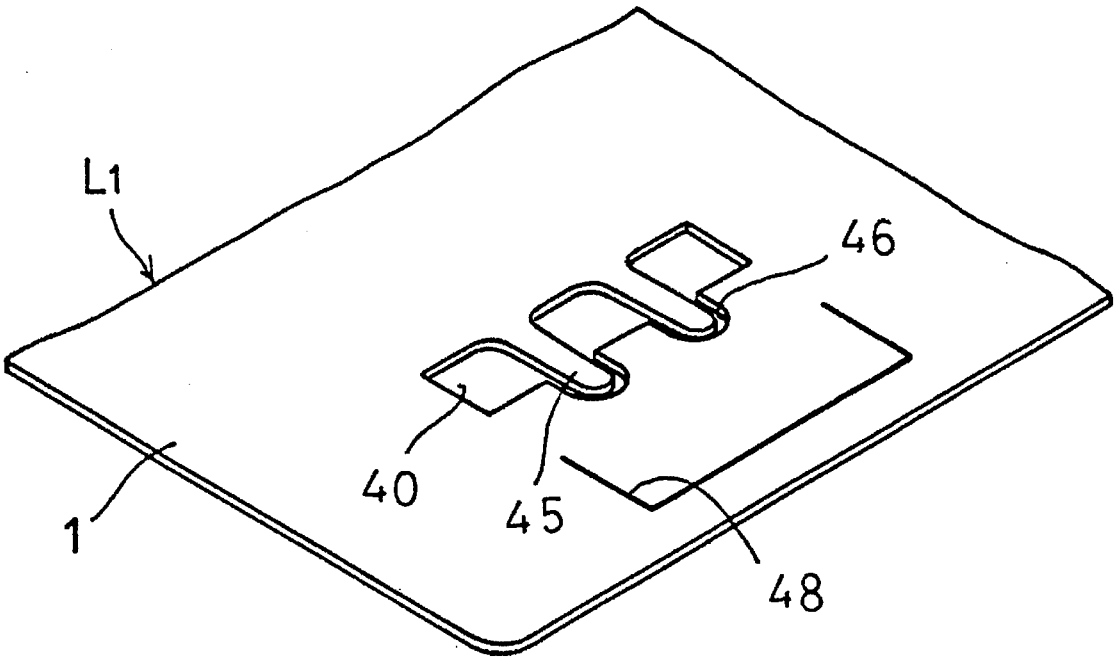
FIG. 16A is a perspective view of a sixth embodiment showing the state before the second film inserting holes are formed.
Figure 16B:
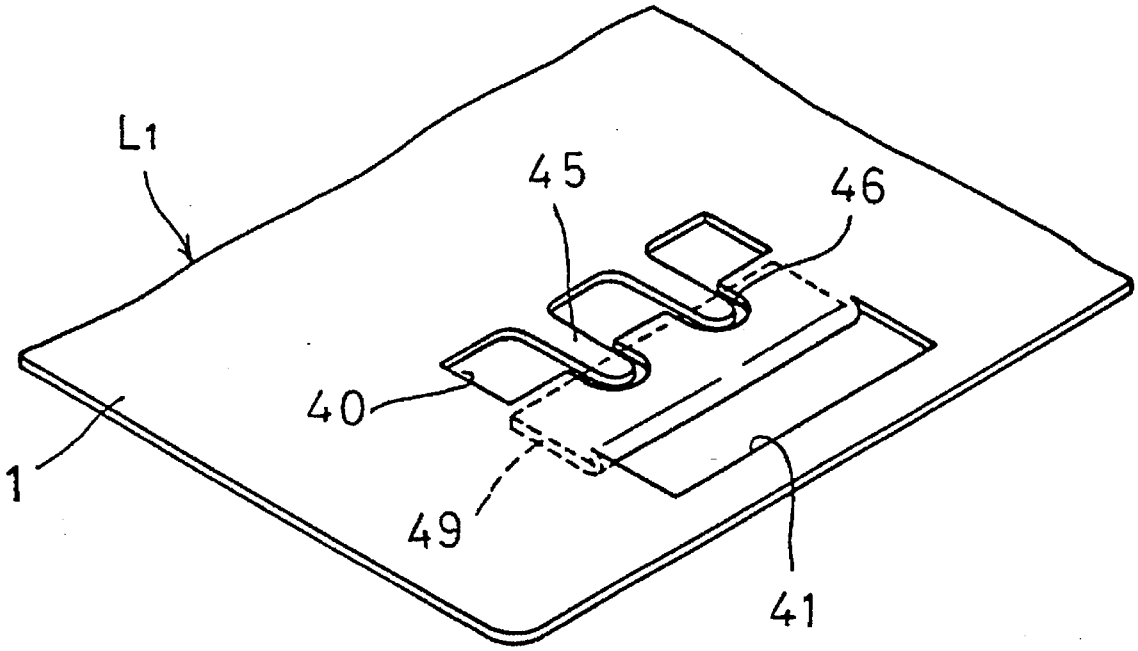
FIG. 16B is a perspective view of the embodiment shown in FIG. 16A showing the second film inserting holes.

FIGS. 16A and 16B show a sixth embodiment of the present invention. In this embodiment, instead of the sheet members 47 used in the fifth embodiment, V-shaped cuts 48 are formed in the leader body rearwardly (with respect to the feed direction of the leader) of the first holes 40. The portions of the leader body delineated or defined by the cuts 48 are bent toward the backside of the leader body 1 to form second holes 41. The bent portions 49 are bonded to the back of the leader body 1 to support the tips of the protrusions 45.

Figure 17A:
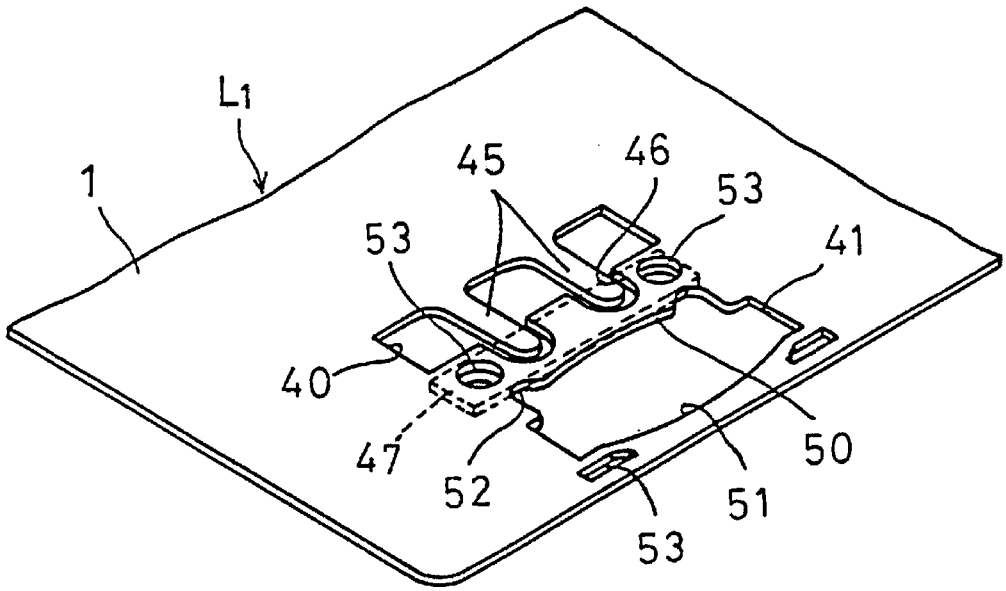
FIG. 17A is a perspective view of a leader of a seventh embodiment of the present invention.
Figure 17B:
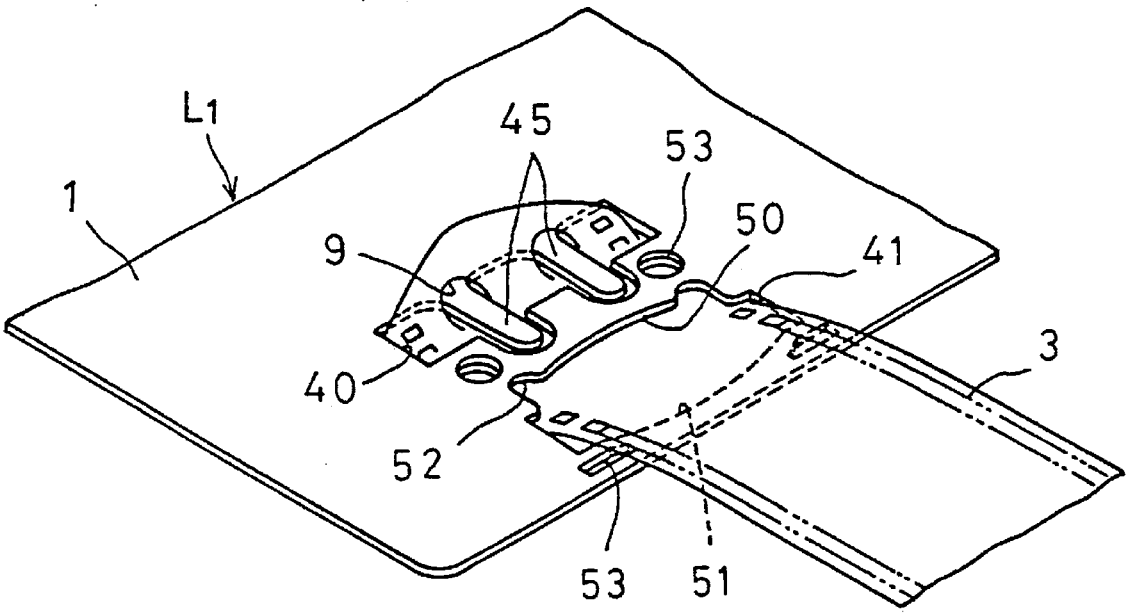
FIG. 17B is a perspective view of the leader shown in FIG. 17A and a film connected thereto.
Figure 18:
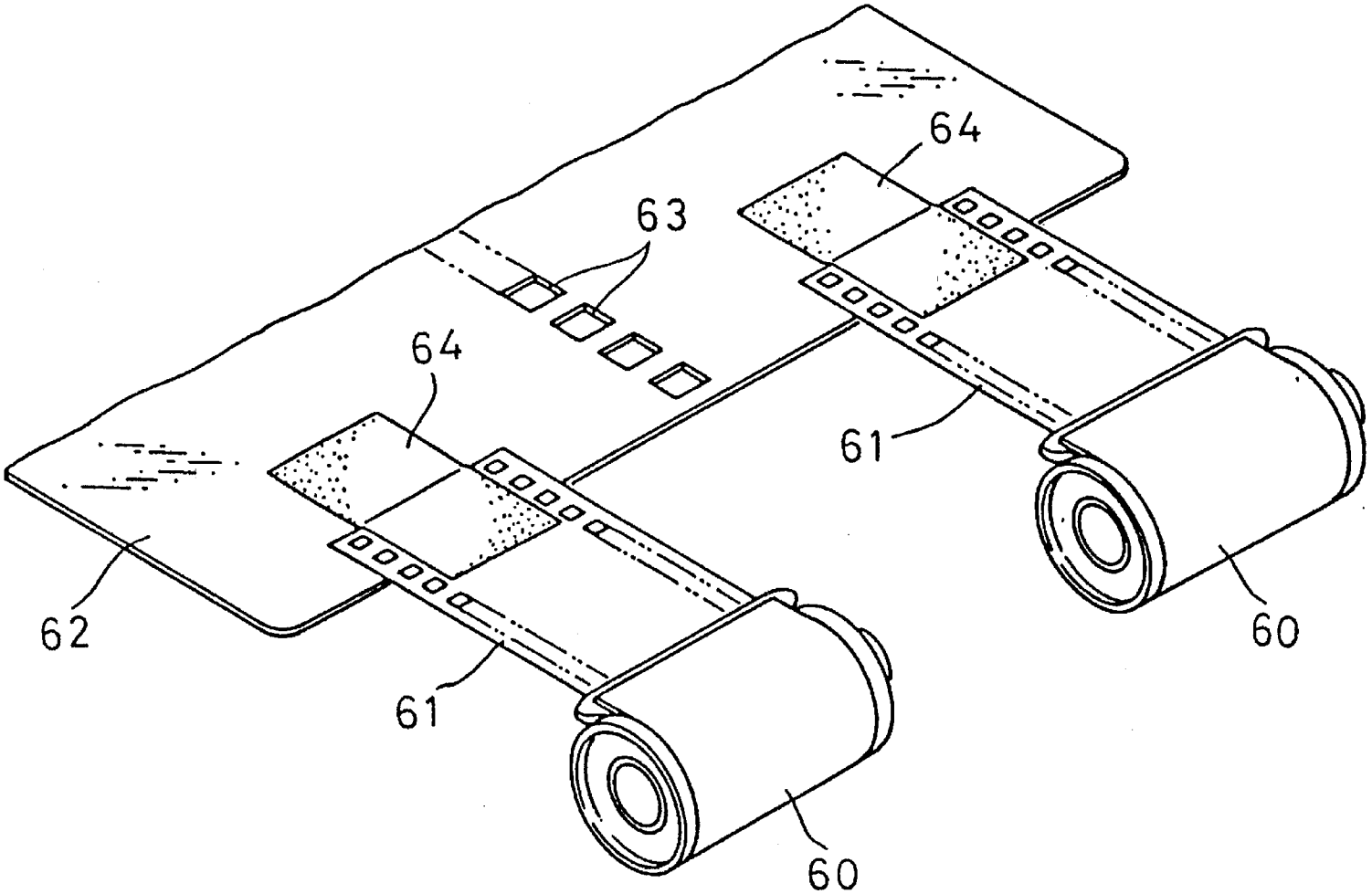
FIG. 18 (PRIOR ART)
FIG. 18 is a perspective view of a conventional film connecting means.
Figure 19:
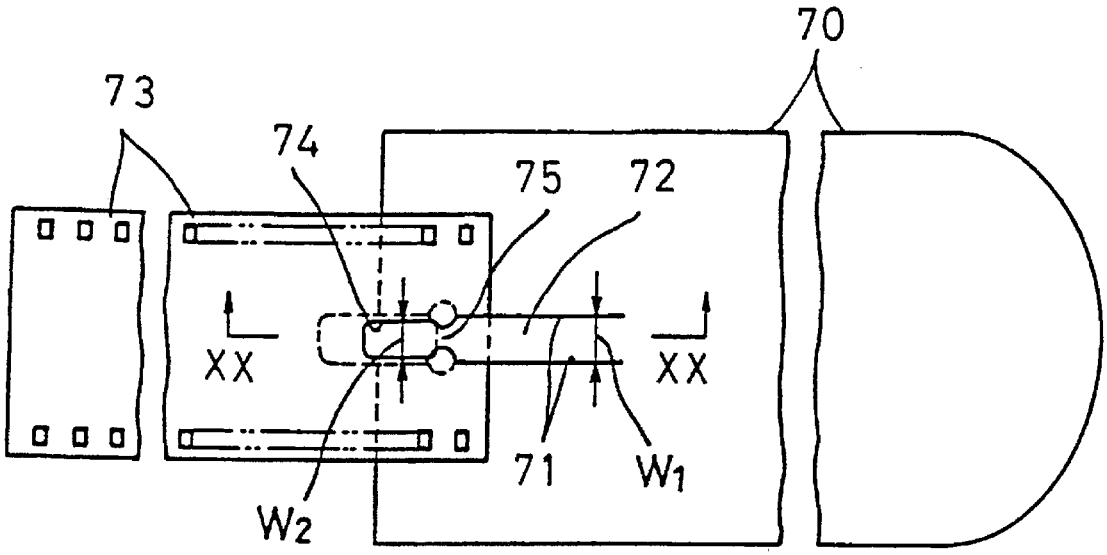
FIG. 19 PRIOR ART
FIG. 19 is a front view of another conventional film connecting means.
Figure 20:
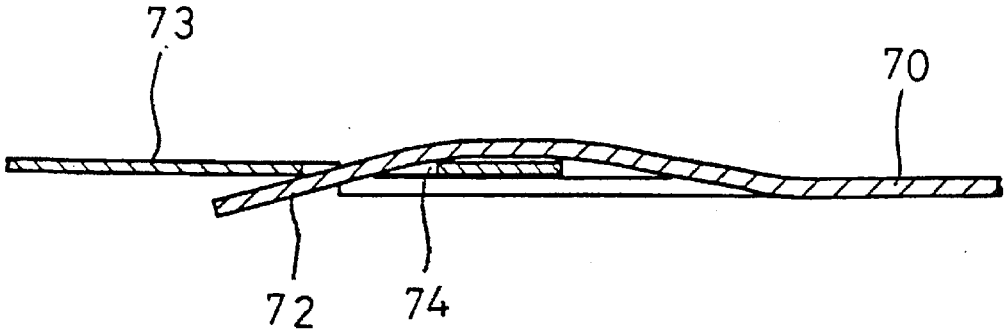
PRIOR ART FIG. 20
FIG. 20 is a sectional view taken along line XX—XX of FIG. 19.

FIGS. 17A and 17B show the seventh embodiment of the present invention. In this embodiment, the second holes 41 have arcuate front and rear edges 50 and 51. Cutouts 52 are formed at both ends of the front edge 50.

The leader body is also formed with vent holes 53 at portions where the films 3 overlap.

Otherwise, the embodiment illustrated in FIGS. 17A–17B is structurally the same as the fifth embodiment shown in FIG. 5. Thus, like elements are denoted by like reference numerals and their description is omitted.

In the seventh embodiment, since the second holes 41 have arcuate front and rear edges, the films connected to the leader are come into contact with the respective front and rear edges 50 and 51 at two points. Thus, when drying the films 3 after developing by blowing hot air, it is possible to completely and quickly vaporize any treating solution trapped between the films and the leader L1. Namely, developed films can be dried quickly and efficiently.

By providing vent holes 53 in the leader body 1, it is possible to reduce the contact area between the leader body and the films and thus to improve air permeability at the contact area between the leader body 1 and the films 3. Thus, the drying efficiency is further improved. Due to the reduced contact area, the films 3 are less likely to be damaged.

The following are the major advantages of this invention:

1) By inserting the tip of each film into the hole formed in the leader body, the protrusions engage in the holes formed in the film. Thus, the film can be easily and, if so desired, automatically connected to and disconnected from the leader.

2) The protrusions have free ends supported on the leader body or the sheet members near the rear edge of the holes for inserting films. The protrusions are thus less likely to be bent and sink into the holes, so that the films are connected to the leader with high reliability.

3) By providing cutouts rearwardly (with respect to the feed direction of the leader) of the film inserting holes and by further providing engaging portions on both sides of each cutout, it is possible to connect the films more reliably to the leader.

4) Since the widths of the film inserting holes and cutouts are substantially the same as the width of the films, it is possible to prevent meandering of the films while being fed.

5) By forming the second holes rearwardly (with respect to the feed direction of the leader) of the film inserting holes, the films can be more rigidly and reliably connected to the leader.

6) In the arrangement in which the second film inserting holes have arcuate front and rear edges, it is possible to completely remove treating solution by drying the films. By forming the vent holes, air permeability at the contact areas between the films and the leader improves, so that it is possible to dry films more efficiently.

7) Since the second film inserting holes have a width substantially equal to the width of the films, it is possible to prevent meandering of the films more reliably.

What is claimed is:

1. A leader comprising:

a leader body, formed of a flexible sheet of material, having a plurality of equally spaced aperatures for feeding the leader and a first film insertion hole formed in said leader body; and a plurality of protrusions, extending across said first film insertion hole, each having a front end and a rear end with respect to the feed direction of the leader, wherein said front ends of said plurality of protrusions are integrally connected to said leader body and said rear ends of said plurality of protrusions are supported at an edge portion of said first film insertion hole.

2. The leader as claimed in claim 1, wherein said leader body includes a plurality of first film insertion holes formed in a rear portion of said leader body with respect to the feed direction of the leader.

3. The leader as claimed in claim 1, further comprising a sheet member fixed to a surface of said leader body and aligned with said first film insertion hole, wherein said plurality of protrusions are integrally formed with said sheet member.

4. The leader as claimed in claim 3, wherein said first film insertion hole has a width which is substantially equal to the width of a film which is to be fed through said first film insertion hole.

5. The leader as claimed in claim 3, wherein said leader body further includes a film insertion cutout formed rearwardly of said first film insertion hole, said film insertion cutout defining a pair of film engaging projections extending from opposite sides of said cutout.

6. The leader as claimed in claim 1, further comprising a sheet member fixed to a lower surface of said leader body in alignment with said first film insertion hole, wherein said front ends of said plurality of protrusions are integrally formed with said leader body and said rear ends of said plurality of projections are supported on said sheet member.

7. The leader as claimed in claim 6, wherein said first film insertion hole has a width which is substantially equal to the width of a film which is to be fed through said film insertion hole.

8. The leader as claimed in claim 6, wherein said leader body further includes a film insertion cutout formed rearwardly of said first film insertion hole, and defining a pair of film engaging projections extending from opposite sides of said cutout.

9. The leader as claimed in claim 1, wherein said first film insertion hole has a width which is substantially equal to the width of a film which is to be fed through said first film insertion hole.

10. The leader as claimed in claim 9, wherein said leader body further includes a film insertion cutout formed rearwardly of said first film insertion hole, said film insertion cutout defining a pair of film engaging projections extending from opposite sides of said cutout.

11. The leader as claimed in claim 1, wherein said leader body further includes a film insertion cutout formed rearwardly of said first film insertion hole, said film insertion cutout defining a pair of film engaging projections extending from opposite sides of said cutout.

12. The leader as claimed in claim 11, wherein said cutout has a width which is substantially equal to the width of a film which is to be fed through said film insertion cutout.

13. The leader as claimed in claim 1, wherein said leader body further includes a second film insertion hole formed rearwardly of said first film insertion hole.

14. The leader as claimed in claim 13 wherein said second film insertion hole has an arcuate front edge and an arcuate rear edge.

15. The leader as claimed in claim 14, wherein said leader body further includes:

at least one vent hole located between said second film insertion hole and a rear edge of said leader body; and at least one vent hole located between said first film insertion hole and said second film insertion hole.

16. The leader as claimed in claim 14, wherein said second film insertion hole has a width which is substantially equal to the width of a film which is to be fed through said second film insertion hole.

17. The leader as claimed in claim 13, wherein said leader body further includes:

at least one vent hole located between said second film insertion hole and a rear edge of said leader body; and at least one vent hole located between said first film insertion hole and said second film insertion hole.

18. The leader as claimed in claim 17, wherein said second film insertion hole have a width which is substantially equal to the width of a film which is to be fed through said second film insertion hole.

19. The leader as claimed in claim 13, wherein said second film insertion hole have a width which is substantially equal to the width of a film which is to be fed through said second film insertion hole.

20. A combination of a leader and a film comprising:

a leader body, formed of a flexible sheet of material, having a plurality of equally spaced aperatures for feeding the leader, said leader body having a first film insertion hole formed in a rear portion of said leader body with respect to a feed direction of the leader, and a plurality of projections, extending across said first film insertion hole, each said plurality of protrusions has a front end which is integrally connected to said leader body and a rear end which is supported at an edge portion of said film insertion hole; and a leading film end having a plurality of leader engaging holes, said plurality of leader engaging holes being positioned such that said protrusions engage in said leader engaging holes upon insertion of said leading film end through said first film insertion hole.

* * * * *